US006715168B2

(12) United States Patent
Williams

(10) Patent No.: US 6,715,168 B2
(45) Date of Patent: Apr. 6, 2004

(54) MOSQUITO NET FRAME

(76) Inventor: Troy Eugene Williams, 102 W. High St., Marion, NC (US) 28752

( * ) Notice: Subject to any disclaimer, the term of this patent is extended or adjusted under 35 U.S.C. 154(b) by 0 days.

(21) Appl. No.: 10/382,415

(22) Filed: Mar. 6, 2003

(65) Prior Publication Data

US 2003/0145378 A1 Aug. 7, 2003

Related U.S. Application Data

(63) Continuation-in-part of application No. 29/146,276, filed on Aug. 3, 2001.

(51) Int. Cl.[7] ..... A47C 29/00
(52) U.S. Cl. ..... 5/414; 5/113; 135/96
(58) Field of Search ..... 5/413.12, 414, 5/110, 113; 135/96

(56) References Cited

U.S. PATENT DOCUMENTS

| | | | | | |
|---|---|---|---|---|---|
| 364,415 | A | * | 6/1887 | Hooper | 5/414 |
| 505,409 | A | * | 9/1893 | Morrell | 5/112 |
| 665,299 | A | * | 1/1901 | Wood | 5/112 |
| 699,835 | A | * | 5/1902 | Chorlton | 5/113 |
| 800,530 | A | * | 9/1905 | Young | 5/112 |
| 1,021,930 | A | * | 4/1912 | Jackson | 135/121 |
| 1,395,158 | A | * | 10/1921 | Smith | 5/113 |
| 1,737,664 | A | * | 12/1929 | Maness | 135/142 |
| 2,301,511 | A | * | 11/1942 | Boyce | 5/113 |
| 2,357,056 | A | * | 8/1944 | Nelson | 135/137 |
| 2,690,186 | A | * | 9/1954 | Ball | 5/415 |
| 2,841,803 | A | * | 7/1958 | Bodling | 5/113 |
| D274,679 | S | * | 7/1984 | Stehlik | D6/392 |

* cited by examiner

*Primary Examiner*—Michael F. Trettel
(74) *Attorney, Agent, or Firm*—Robert R. Reed

(57) ABSTRACT

The present invention provides a mosquito net frame. A rectangular top frame portion of the mosquito net frame is realized by easily assembling square tubes or rods and fittings together. Square tubes or rods are also used for corner columns that also interface with the fittings of the top frame at each corner of the top frame. A foot is added at the bottom of each column to assist in supporting the mosquito net frame from a frame of a cot or from a ground surface. A conventional mosquito netting or other fabric is supported by the mosquito net frame to protect a sleeping person. Disassembly and transport is realized by simply pulling the square tubes from the fittings and placing the components in a container with a secured lid for carrying, shipping and storing the mosquito net frame.

19 Claims, 4 Drawing Sheets

MOSQUITO NET FRAME

This application is a continuation-in-part of 29/146,276 filed Aug. 3, 2001.

BACKGROUND OF THE INVENTION

This invention is directed to the protection of persons who are sleeping outdoors from insects and more particularly to protect field military personnel subject to mosquito bites and the like when sleeping on a cot or on the ground in a sleeping bag in a insect infested location.

This invention relates to a class of canopies using a mosquito net or other similar fabric to be spread over beds, cots, cradles and the like to protect a person from mosquitos and other annoying insects. In particular, the framework supporting such net or fabric is the focus of this invention. In this connection it is appreciated that it is or critical importance to provide military field equipment with such a design that the military personnel may be protected from mosquitos and other insects while sleeping. It is also essential that any equipment provided for the military shall be as small as possible and light in weight in order that it be portable in the field. Any assembly and maintenance should create no new operational problems.

Typical canopy supports of the art are disclosed in U.S. Pat. Nos. 364,415; 800,530; 2,301,511; and 2,841,803. Some type of suitable material is typically supported by a frame. The disclosure of Hooper ('405) illustrates a netting for a bed supported by four standards (columns) having bands or cords extending between columns to support the netting. The columns are held in place by feet inserted beneath the legs of the bed. No disclosure of a top frame is apparent with this disclosure and the system has limited portability.

The patent of Young ('530) discloses a frame supporting any suitable material canopy. Posts or standards are secured to the ends of the cot legs and rings connected to the side bars prevent the posts from falling outwardly. Upper canopy side bars are removably secured to the upper end of the posts on each side to properly stretch and hold in place the canopy material. The frame of Young remains attached to the cot when the cot is folded.

The patent by Boyce ('511) discloses a mosquito bar support at each end of a conventional army cot comprising vertical supporting rods each held in place by an upper supporting loop around the frame of the cot and a base loop around the lower end of a supporting leg. The top of the supporting rods have telescoping sleeves to receive a cross-bar. The mosquito-bar or fabric is stretched from one end assembly to the other end assembly and secured by tying the fabric to the cot. There is no apparent supporting members along each side to help support the fabric.

In the patent of Bodling ('803) a tent is constructed over a cot by providing a frame located lengthwise above the center of the cot. Uprights at each end have pins at their lower ends adapted to be socketed in vertical holes formed medially in the end rails of the cot. A hinged ridge pole at the top of the uprights provides support for a mesh netting between the ridge pole and the lateral edges of the cot, like a pup-tent.

Cots of various types are disclosed in the art referenced above. Additional folding cot designs are disclosed in U.S. Pat. No. 505,409 by Morrell and Des. Pat. No. 274,679 by Stehlik. The sleeping cot of interest in the present invention is a standard issue conventional army cot approved for military use at the present time. This particular cot is equipped with apertures in the end cross bars that can be used to help support the mosquito net frame of this invention.

A need exists to have a supporting frame for a mosquito net and the like that gives adequate support for most environmental applications. The need to have a mosquito net frame that can be easily assembled, used, disassembled and transported to another location is critical for military applications. The mosquito net frame should also be made for use without the presence of a sleeping cot. Use with a sleeping bag placed on the ground surface is also an important military requirement. Therefore, the mosquito net frame should not depend on the presence of a sleeping cot.

Accordingly, an object of the present invention is to provide a mosquito net frame of such a design to be of extremely light weight, easily portable and adapted to be packed and shipped in containers of relatively small bulk.

A further object of the present invention is to provide a sectional mosquito net frame that is designed to allow the individual components to be easily fitted together as an assembled unit in a short time and be instantly dismantled.

Another object of the present invention is to provide the mosquito net frame with a minimum number of different components and use components that are obviously placed so that assembly and disassembly is easily achieved without errors.

Still another object of the present invention is to provide the mosquito net frame that uses the standard features of a conventional military type canvass cot to easily support the frame.

Yet another object of the present invention is to define a method for providing easy assembly of the mosquito net frame for placement in use.

Further objects will appear from the following description taken in connection with the drawings included in and forming a part of this invention.

SUMMARY OF THE INVENTION

The above objectives are accomplished according to the present invention by providing a top frame that can be easily assembled in supporting a mosquito net to protect a person from mosquitos and the like while sleeping. Vertical columns are used to position the top frame a desired distance above a person being protected. Using light weight tubes that are connected together by fittings at the corners and along the sides provides components that are easily stored and carried from place to place in a container. A foot affixed to the bottom end of each column provides support for the completed frame and protects the tubes from collecting debris.

In one embodiment of the invention a portable mosquito net frame is supported by a sleeping cot and carrying a mosquito net to protect a person from the outside environment. The mosquito net frame comprises a rectangular top frame disposed above the person having a length and a width approximately equal to that of the cot. A plurality of square tubes form side members along the length and cross members across the width of the top frame. A pair of T-shaped center fittings are provided for removably connecting a pair of the square tube side members near the center of the length of the top frame and removably connecting one square tube cross member extending across the width of the top frame. Double square corner fittings are provided for removably connecting the square tube side members to square tube cross members at each corner of the top frame. Corner columns comprising square tubes are removably connected vertically at a top end to the double square corner fittings at each corner of the top frame. A foot is affixed at the bottom end of each one of the corner columns to removably support the mosquito net frame from the sleeping cot.

In another embodiment of the invention, a portable mosquito net supporting system for use in a military environment over a sleeping cot is provided. The system comprises a generally horizontal top frame having four side members and three cross members generally forming a length and a width respectively of the top frame. A T-shaped center fixture removably connects two of the side members linearly together to form each lateral side of the top frame. A double square corner fitting is installed at each end of the lateral side to form four corners of the top frame. The cross members connect widthwise adjacent pairs of the corner fixtures and the T-shaped center fixtures. Corner columns connect vertically at a top end to each double square corner fitting to form legs supporting the top frame at a predetermined height. A foot is affixed at the bottom end of each of the corner columns to help support the top frame for receiving the mosquito net.

In a further embodiment of the invention, a method is used for supporting a mosquito net above a ground surface for protecting a sleeping person. The method comprises the first step (1) of providing a plurality of square tubes of the same cross-sectional size but of different length to include four side members, three cross members and four corner columns. A second step (2) includes providing four double square corner fittings and two T-shaped center fittings each having apertures to removably receive and hold the plurality of square tubes. In a third step (3) the method includes assembling a top frame having a length to include two side members linearly connected by one of the T-shaped center fittings on each lateral side and one of the double square corner fittings on each free end of the linearly connected side members. A forth step (4) includes forming a width of the top frame by adding cross members extending between, and removably connected to, adjacent double square corner fittings and adjacent T-shaped center fittings near a center of the length of the top frame. In step five (5) the method includes installing a leg at each corner of the top frame by removably inserting one end of the square tube corner column into the double square corner fitting to become perpendicular to the top frame. A sixth step (6) includes forming a foot integral with a bottom end of each of the square tube corner column for providing a complete mosquito net frame having a length, a width and a height to provide support for coverage by the mosquito net greater than the dimensions and elevation of the sleeping person in a lying position.

In further aspects of the invention the square tubes have a cross-section of only 0.25 inch square and are made of a high strength aluminum alloy for reducing the weight of the mosquito net frame. The fittings have apertures to receive and hold the square tubes by friction and the square tubes can be removed from the fittings without using any tools. The mosquito net frame can be supported by a standard conventional military cot or simply placed on the ground surface.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 is a perspective view of a mosquito net frame of this invention supported by a sleeping cot setting on a ground surface for carrying a net to protect a person from mosquitos and the like;

FIG. 5 is a perspective view of a mosquito net frame of this invention positioned over a sleeping bag and supported by a ground surface for carrying a net to protect a person from mosquitos and the like; and FIG. 6 is a container for transporting the components of the mosquito net frame having a lid to secure the components during transport.

DESCRIPTION OF A PREFERRED EMBODIMENT

Referring now in more detail to the drawings, the invention will now be described in more detail. A rectangular top frame portion of the mosquito net frame is realized by easily assembling square tubes or rods and fittings together. Square tubes or rods are also used for corner columns that also interface with the fittings of the top frame at each corner of the top frame. A foot is added at the bottom of each column to assist in supporting the mosquito net frame from a frame of a cot or from a ground surface. A conventional mosquito netting or other fabric is supported by the mosquito net frame to protect a sleeping person. Disassembly and transport is realized by simply pulling the square tubes from the fittings and placing the components in a container with a secured lid for carrying, shipping and storing the mosquito net frame.

Figure 1:
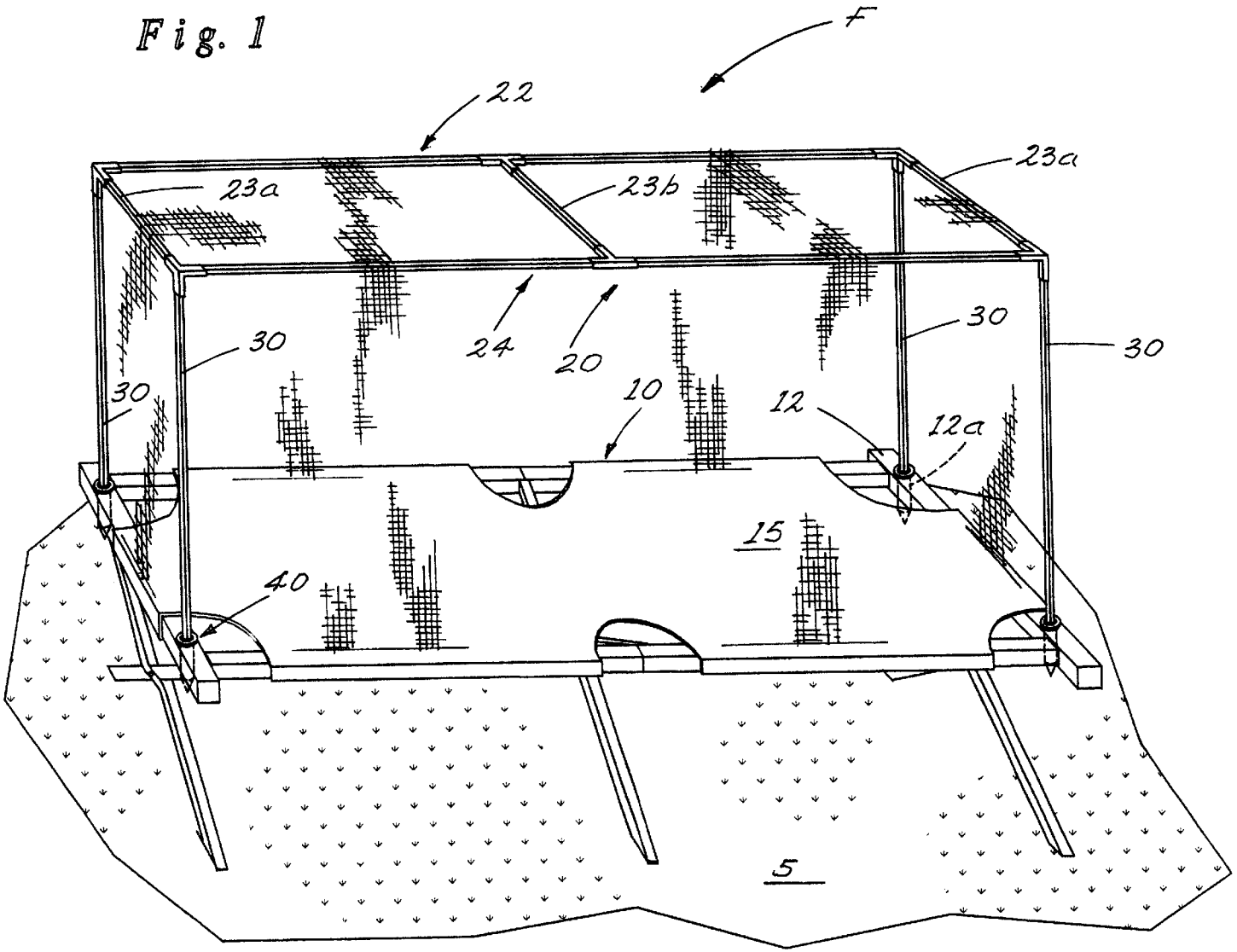

The mosquito net frame "F" of FIG. 1 is shown being supported by a conventional military sleeping cot 10 supported on a ground surface 5. A top frame 20 is supported above the cot by corner columns 30. The top frame is easily assembled to include lateral sides 22 and 24 separated by end cross members 23*a* and a center cross member 23*b*. The cot has a frame 12 including rails and legs. Each corner column has a foot 40 at a bottom end. When the mosquito net frame is supported by the sleeping cot, existing apertures 12*a* in the end rails of the cot are used to stabilize the mosquito net frame by receiving the four feet of the cot. The length and width of the mosquito net frame are predetermined to fit the dimensions of the apertures of the frame of the cot. Once mosquito net frame F is assembled and placed over sleeping cot 10, a mosquito netting or fabric 15 can be supported to protect a person (not shown) sleeping on the cot.

Figure 2:
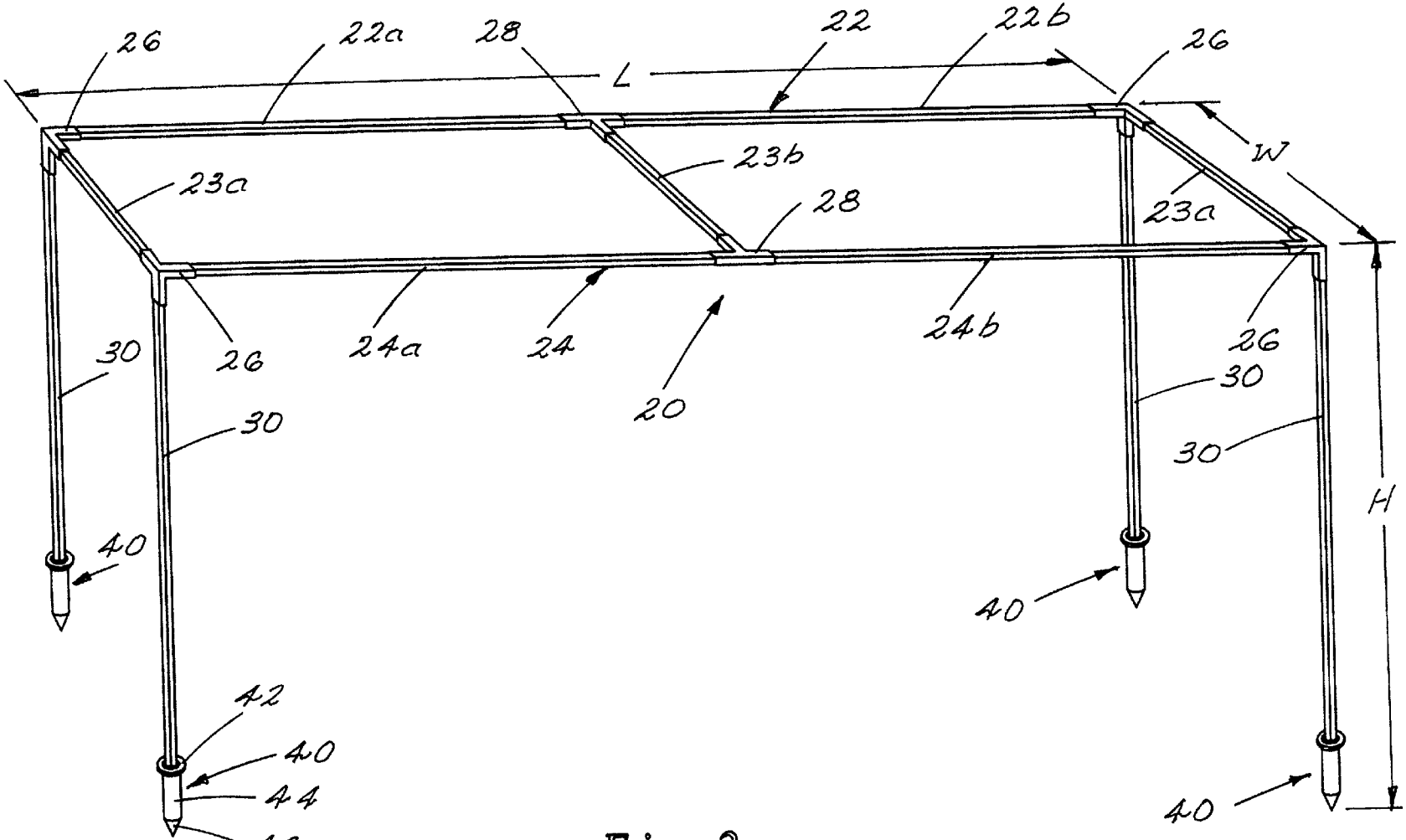
FIG. 2 is a perspective view of the mosquito net frame of this invention to be supported on a sleeping cot or placed on the ground.

The mosquito net frame is shown in more detail in FIG. 2. The size of the mosquito net frame is defined by a length "L", a width "W" and a height "H" to fit the needs of the application. A common size for a sleeping cot has a length of about 78 inches a width of about 27 inches and a height of about 40 inches. Lateral sides 22 and 24 are each assembled to include two square tubes connected to a T-shaped center fitting 28. Square tubes 22*a* and 22*b* are connected on lateral side 22 and square tubes 24*a* and 24*b* are connected on lateral side 24. Each lateral side is connected so the sides are straight, or linearly connected. Connected to the both ends of each lateral side is a double square corner fitting 26; which provides the four corners of the mosquito net frame and establishes length L. A square tube cross member 23*a* is connected between adjacent corner fittings 26 to establish width W. Another square tube cross member 23*b* is connected between adjacent T-shaped center fittings to complete a rectangular top frame 20 of the mosquito net frame. Square tube corner columns 30 are connected a top end to the double square corner fittings. A foot 40 is added to a bottom end of the corner columns to complete the mosquito net frame and establish height H. The foot is affixed to the bottom end of each corner column 30 and includes a stop plate 42, a round tube 44 and a bottom cap 46. The foot allows the mosquito net frame to fit the apertures in the frame of the conventional military sleeping cot (see FIG. 1).

The mosquito net frame can be constructed using any metallic material for all the components including the square tubes, the fittings and the foot. Preferably the mosquito net frame is made of a high strength aluminum or aluminum alloy; such as a standard ASTM designation 7075 structural aluminum alloy. The overall weight of the mosquito net frame can be reduced by using aluminum. The use of aluminum will also provide components which are corrosion resistant. The tubes can be hollow members or a solid rod. The preferred cross-section is a solid for added strength and crush resistance. The shape of the tubes can also be round. However, the preferred shape is square, so the tubes will be stable when disposed on a flat surface. The cap at the bottom of the foot can be made of a plastic material.

Figure 3:
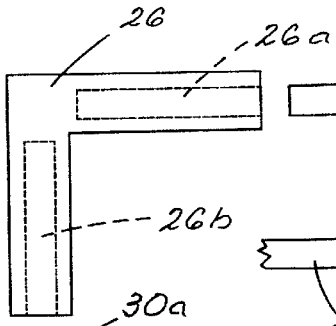
FIG. 3 is an exploded elevation view of a corner portion of the mosquito net frame showing the various components separated one from the other prior to assembling the frame.
Figure 3:
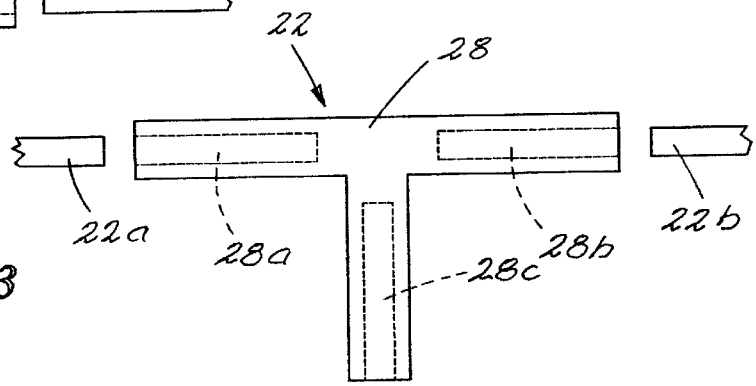
Figure 3A:
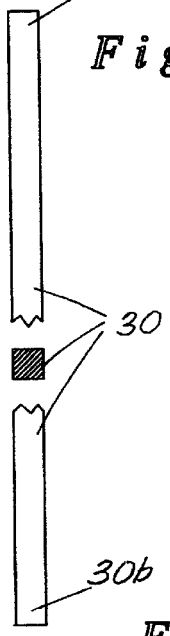
FIG. 3A is an elevation view of the foot portion of the mosquito net frame after the foot components have been welded to a corner column.
Figure 3A:
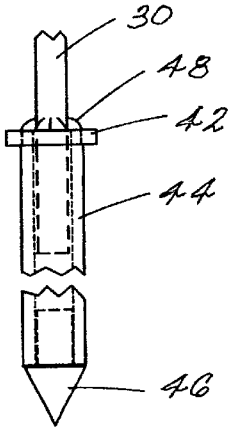

To better define the assembly and structural features of the mosquito net frame, refer to the exploded view of a corner assembly illustrated in the exploded elevation view of FIG. 3. Double square corner fitting 26 has an aperture 26*a* for receiving the square tube 24*a* of the lateral side member of the top frame and an aperture 26*b* for receiving a top end 30*a* of square tube corner column 30. A bottom end 30*b* of the corner column is equipped with a foot 40. The foot includes a stop 42 made like a washer with a center aperture 42*a* to receive a round tube 44. The round tube has a center bore 44*a* to receive bottom end 30*b* of the corner column. The round tube has a size to fit the apertures of the cot frame. A pointed cap 46 closes the round tube and keeps debris from getting into the round tube. The cap has a round shaft 46*a* that fits into the center bore of the round tube. The pointed shape of the cap help stabilize the mosquito net frame when it sits on the ground surface. The foot is affixed to the bottom end of the corner column as illustrated in FIG. 3A. When the foot is assembled with round tube 44 in the aperture of stop 42 and corner column 30 inside the center bore of the round tube, a weld 48 at the top of the round tube attaches the foot to the corner column; not to be removed with disassembly of the mosquito net frame.

Figure 4:
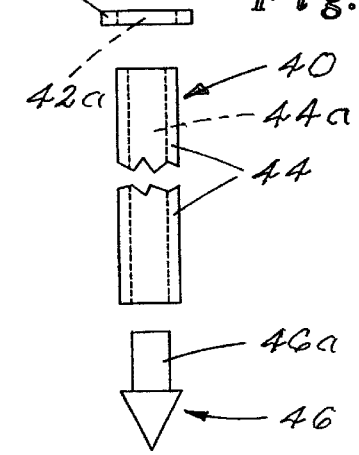
FIG. 4 is an exploded plan view of the center portion of the mosquito net frame showing the various components separated one from another prior to assembling the components.
Figure 4:
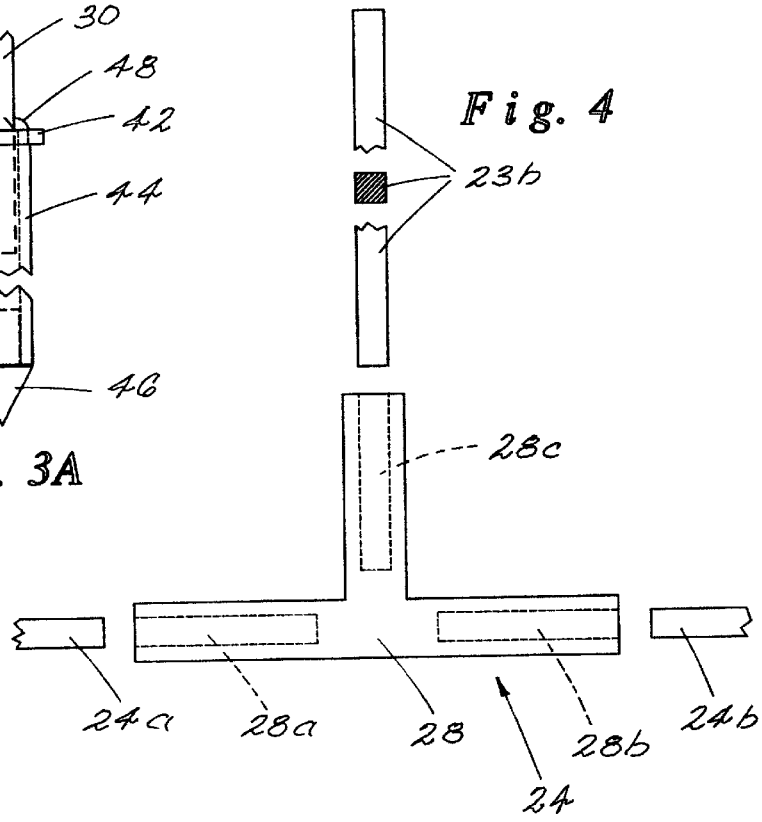

To further help define the assembly and structural features of the mosquito net frame, refer to the exploded plan view of a center segment of the mosquito net frame of FIG. 4. The T-shaped center fittings 28 are a part of the lateral sides forming the overall length of the mosquito net frame. Side members 22*a* and 22*b* fit into apertures 28*a* and 28*b* respectively along lateral side 22. Side members 24*a* and 24*b* fit into apertures 28*a* and 28*b* respectively along lateral side 24. Square tube cross member 23*b* fits into apertures 28*c* on both lateral sides to help establish the width of the top frame.

The apertures of fittings 26 and 28 are made to have a snug fit with the square tubes at each connection. No tools are needed to connect or disconnect the square tubes with the fittings. When connected, the square tubes remain in the fittings unless a force is applied by hand to pull the components apart. A preferred length of each aperture of a fitting is about 1.5 inches to hold the 0.5 inch square tube.

Figures 5, 6:
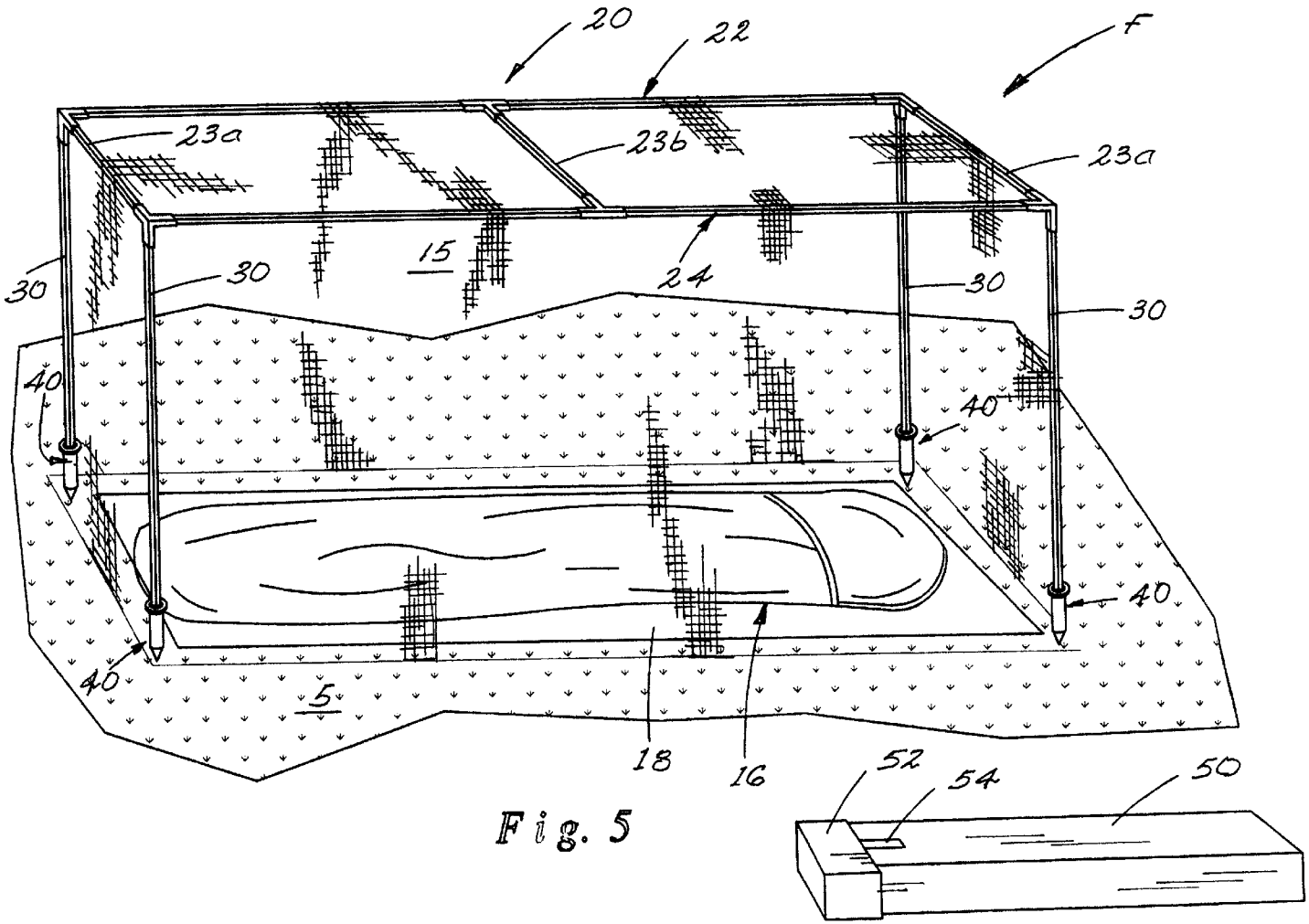

In another aspect of the invention the mosquito net frame is place upright directly on the ground surface. This application is used when a sleeping bag is placed on the ground without using a sleeping cot, as illustrated in FIG. 5. The mosquito net frame once again includes a top frame 20 having lateral sides 22 and 24 separated by cross members 23*a* and 23*b*. A sleeping bag 16 is commonly placed on a mat 18 placed directly on ground surface 5. The top frame is large enough for corner columns 30 to be positioned outside the area of the mat. Each foot 40 at the bottom end of the corner columns helps stabilize the mosquito net frame on the ground surface. Mosquito netting or fabric 15 placed over the mosquito net frame will protect a person from mosquitos and the like.

Shipping, storing and carrying the mosquito net frame is critical for military use. A square container 50 to meet the needs for military use is illustrated in FIG. 6. The container has a lid which is secured by a lid strap 54. The smaller the container the better it is to manage. A preferred size is about 2.5 to 3.0 inches square by about 40 inches long. The square container is stable on a flat surface. The container can be produced economically by using a plastic material with a hook and loop strap attachment.

While a preferred embodiment of the invention has been described using specific terms, such description is for illustrative purposes only, and it is to be understood that changes and variations may be made without departing from the spirit or scope of the following claims.

What is claimed is:

1. A portable mosquito net frame supported by a sleeping cot and carrying a mosquito net to protect a person from the outside environment comprising:

a rectangular top frame disposed above the person having a length and a width approximately equal to that of the cot;

a plurality of square tubes forming side members along said length and cross members across said width of said top frame;

a pair of T-shaped center fittings for removably connecting a pair of said square tube side members near the center of said length of said top frame and removably connecting one square tube cross member extending across said width of said top frame;

double square corner fittings for removably connecting said square tube side members to square tube cross members at each corner of said top frame;

square tube corner columns removably connected vertically at a top end to said double square corner fittings at each corner of said top frame; and a foot affixed at a bottom end of each said corner column to removably support the mosquito net frame from the sleeping cot.

2. The frame of claim 1 wherein said square tubes of said side members and cross members are made of a metallic material with cross-sectional dimensions of 0.25 inch square.

3. The frame of claim 1 wherein said square tubes of said corner columns are made of a metallic material with cross-sectional dimensions of 0.25 inch square.

4. The frame of claim 2 wherein said metallic material is a high strength aluminum.

5. The frame of claim 3 wherein said metallic material is a high strength aluminum.

6. The frame of claim 1 wherein said foot includes a stop plate with an aperture and a round tube with a cap at a lower end of said round tube, wherein a top end of said round tube fits into said aperture of said stop plate and a respective corner column fits into said round tube so that said foot is affixed to said corner column by a weld at a top edge of said foot.

7. The frame of claim 6 wherein said stop plate and said round tube are made of the same metallic material as that of said corner column and said cap is made of a plastic material.

8. The frame of claim 1 wherein said double square corner fittings are each made as one piece to include apertures to receive one of said square tube side members, one of said square tube cross members and one of said square tube corner columns, wherein said square tubes are held in place by friction within the corner fitting and removed as necessary for portability of the frame.

9. The frame of claim 8 wherein said T-shaped center fittings are each made as one piece to include apertures to receive two of said square tube side members and one of said square tube cross members, wherein said square tubes are held in place by friction within the center fitting and removed as necessary for portability of the frame.

10. A method for supporting a mosquito net above a ground surface for protecting a sleeping person at predetermined locations comprising the steps of:

a) providing a plurality of square tubes of the same cross-sectional size but of different length to include four side members, three cross members and four corner columns;

b) providing four double square corner fittings and two T-shaped center fittings each having apertures to removably receive and hold said plurality of square tubes;

c) assembling a top frame having a length to include two side members linearly connected by one of said T-shaped center fittings on each lateral side and one of said double square corner fittings on each free end of said linearly connected side members d) forming a width of the top frame by adding cross members extending between, and removably connected to, adjacent double square corner fittings and adjacent T-shaped center fittings near a center of said length of said top frame;

e) installing a leg at each corner of said top frame by removably inserting one end of said square tube corner column into a double square corner fitting to become perpendicular to said top frame;

f) forming a foot integral with a bottom end of each said square tube corner column for providing a complete mosquito net frame having a length, a width and a height to provide support for coverage by the mosquito net greater than the dimensions and elevation of the sleeping person in a lying position.

11. The method of claim 10 further including the step of supporting said top frame from the square tube corner columns by placing each foot in an aperture provided in the framework of a standard sleeping cot known in the industry.

12. The method of claim 10 further including the step of supporting said top frame from the ground surface by placing each said foot directly on the ground surface.

13. The method of claim 10 wherein the step of forming said foot includes the steps of:

providing a round tube with a stop on the upper end of the round tube;

forming a pointed cap to fit into the bottom end of said round tube to keep debris from getting into the round tube; and welding said corner column, said stop and said round tube together at the top of the round column to affix said foot to said corner column.

14. The method of claim 10 wherein the step of providing said plurality of square rods includes the step of forming said square tubes from a high strength aluminum material having a cross-sectional shape 0.25 inches square.

15. The method of claim 10 including the steps of:

providing a container with a secure lid for shipping storing and carrying components of the mosquito net frame and net;

disassembling said components by reversing steps c) through e) and placing said components within said container and securing said lid; and transporting said components to the next location for reassembly.

16. A mosquito net supporting system for use in a military environment over a sleeping cot comprising:

a generally horizontal top frame having four side members and three cross members generally forming a length and a width respectively of said top frame;

a T-shaped center fitting linearly connecting two of said side members together to form each lateral side of the top frame;

a double square corner fitting installed at each end of said lateral side to form the four corners of said top frame;

cross members connecting widthwise adjacent pairs of said corner fixtures and said T-shaped center fixtures;

corner columns connecting vertically at a top end to each double square corner fitting to form four legs supporting said top frame at a predetermined height; and a foot affixed at the bottom end of each said corner column to help support the top frame to receive the mosquito net.

17. The system of claim 16 wherein side members, cross members and corner columns are made of a high strength aluminum and have a cross-sectional shape 0.25 inches square.

18. The system of claim 16 including two vertical center columns each with a foot at a bottom end, said center columns being affixed at a top end to said T-shaped center fixture to provide intermediate legs helping support said top frame.

19. The system of claim 16 wherein said length is approximately 78 inches said width is approximately 27 inches and said height is approximately 40 inches.

* * * * *